US005749502A

United States Patent [19]

Hinds

[11] Patent Number: 5,749,502

[45] Date of Patent: May 12, 1998

[54] ADVANCED AEROSOL CONTAINER

[76] Inventor: Frank C. Hinds, 2010 Guntersvile Rd., Arab, Ala. 35016

[21] Appl. No.: 587,637

[22] Filed: Jan. 17, 1996

[51] Int. Cl.[6] ..... B65D 83/00

[52] U.S. Cl. ..... 222/401; 222/386.5; 222/402.15

[58] Field of Search ..... 222/105, 386.5, 222/401, 402, 402.15, 464.1

[56] References Cited

U.S. PATENT DOCUMENTS

| | | | |
|---|---|---|---|
| 2,091,735 | 8/1937 | Jepson | 222/401 |
| 3,998,361 | 12/1976 | Arena | 222/402 X |
| 4,492,320 | 1/1985 | Tada | 222/401 X |
| 5,180,085 | 1/1993 | Schmid | 222/401 X |
| 5,267,674 | 12/1993 | von Schuckmann | 222/401 X |

*Primary Examiner*—Joseph Kaufman

[57] ABSTRACT

A new and improved apparatus for the storage of a liquid and for its dispensing therefrom in a mist form comprising, in combination: a container having cylindrical side walls, a bottom and a dome-shaped top with a central vertical hole extending therethrough; a dispenser formed of a hollow tube extending from adjacent to the bottom of the container to above the hole in the top of the container with a button secured to the top of the tube, the button having a horizontal opening in fluid communication with the tube for the flow of liquid from the bottom of the container to the exterior of the button and the container; a pressure generator for creating a high pressure atmosphere in the space at the upper regions of the container, the pressure generator including a valve formed at the top of the container offset from the hole, the valve having a cylindrical chamber with a lower opening and lower one way diaphragm coupling the chamber and the interior of the container, a reciprocal member having a cylindrical plunger within the chamber and a button exterior of the chamber and container with a central aperture therethrough coupling the chamber and exterior of the chamber and atmosphere, and an upper one way diaphragm coupled to the receptacle member within the chamber whereby when the pressure generator button is pushed downwardly, pressurized air will flow from the chamber into the container and when the pressure generator button is moved upwardly, air will flow from atmosphere passed the upper diaphragm into the chamber; and means to resiliently urge the pressure generator button to the raised position.

3 Claims, 4 Drawing Sheets

ADVANCED AEROSOL CONTAINER

BACKGROUND OF THE INVENTION

1. Field of the Invention

The present invention relates to advanced aerosol container and more particularly pertains to aerosol containers which may be pressurized by a user.

2. Description of the Prior Art

The use of aerosol containers is known in the prior art. More specifically, aerosol containers heretofore devised and utilized for the purpose of dispensing contained liquids in mist form are known to consist basically of familiar, expected and obvious structural configurations, notwithstanding the myriad of designs encompassed by the crowded prior art which has been developed for the fulfillment of countless objectives and requirements.

By way of example, U.S. Pat. No. 3,860,150 to Maier discloses a pump type aerosol dispenser for fluids.

Compressed air as a source for pressurizing the contents of a container is disclosed in U.S. Pat. No. 5,131,569 to Hodgson.

A laterally disposed pump like container for increasing the pressure within a cylindrical dispenser is disclosed in U.S. Pat. Nos. 3,995,779 and 4,147,284 to Mizzi.

Lastly, Mascia discloses an operator controlled pump for increasing the pressure within a cylindrical container in U.S. Pat. No. 4,341,330 to Mascia.

In this respect, the advanced aerosol container according to the present invention substantially departs from the conventional concepts and designs of the prior art, and in so doing provides an apparatus primary developed for the purpose of dispensing fluids under pressure generated by the user.

Therefore, it can be appreciated that there exists a continuing need for a new and improved advanced aerosol container which can be pressurized by a user. In this regard, the present invention substantially fulfills this need.

SUMMARY OF THE INVENTION

In view of the foregoing disadvantages inherent in the known types of aerosol containers now present in the prior art, the present invention provides a new and improved advanced aerosol container. As such, the general purpose of the present invention, which will be described subsequently in greater detail, is to provide a new and improved advanced aerosol container apparatus and method which has all the advantages of the prior art and none of the disadvantages.

To attain this, the present invention essentially comprises of a new and improved apparatus for the storage of a liquid and for its dispensing therefrom in a mist form comprising, in combination a container having cylindrical side walls, a bottom and a dome shaped top with a central vertical hole extending therethrough; a dispenser formed of a hollow tube extending from adjacent to the bottom of the container to above the hole in the top of the container with a button secured to the top of the tube, the button having a horizontal opening in fluid communication with the tube for the flow of liquid from the bottom of the container to the exterior of the button and the container; a pressure generator for creating a high pressure atmosphere in the space at the upper regions of the container, the pressure generator including a valve formed at the top of the container offset from the hole, the valve having a cylindrical chamber with a lower opening and lower one way diaphragm coupling the chamber and the interior of the container, a reciprocal member having a cylindrical plunger within the chamber and a button exterior of the chamber and container with a central aperture therethrough coupling the chamber and exterior of the chamber and atmosphere, and an upper one way diaphragm coupled to the receptacle member within the chamber whereby when the pressure generator button is pushed downwardly, pressurized air will flow from the chamber into the container and when the pressure generator button is moved upwardly, air will flow from atmosphere passed the upper diaphragm into the chamber; and means to resiliently urge the pressure generator button to the raised position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved advanced aerosol container which has all the advantages and none of the disadvantages.

It is another object of the present invention to provide a new and improved advanced aerosol container which may be easily and efficiently manufactured and marketed.

It is a further object of the present invention to provide a new and improved advanced aerosol container which is of a durable and reliable construction.

An even further object of the present invention is to provide a new and improved advanced aerosol container which is susceptible of a low cost of manufacture with regard to both materials and labor, and which accordingly is then susceptible of low prices of sale to the consuming public, thereby making the improved advance aerosol container economically available to the buying public.

Still yet another object of the present invention is to provide a new and improved advanced aerosol container which provides in the apparatuses and methods of the prior art some of the advantages thereof, while simultaneously overcoming some of the disadvantages normally associated therewith.

Still another object of the present invention is to selectively pressurize the contents of aerosol containers.

Yet another object of the present invention is to spray a mist of fluid from a container by a pressure generated by the user.

Even still another object of the present invention is to provide a new and improved apparatus for the storage of a liquid and for its dispensing therefrom in a mist form comprising, in combination a new and improved apparatus for the storage of a liquid and for its dispensing therefrom in a mist form comprising, in combination: a container having cylindrical side walls, a bottom and a dome shaped top with a central vertical hole extending therethrough; a dispenser formed of a hollow tube extending from adjacent to the bottom of the container to above the hole in the top of the container with a button secured to the top of the tube, the button having a horizontal opening in fluid communication with the tube for the flow of liquid from the bottom of the container to the exterior of the button and the container; a pressure generator for creating a high pressure atmosphere in the space at the upper regions of the container, the pressure generator including a valve formed at the top of the container offset from the hole, the valve having a cylindrical chamber with a lower opening and lower one way diaphragm coupling the chamber and the interior of the container, a reciprocal member having a cylindrical plunger within the chamber and a button exterior of the chamber and container with a central aperture therethrough coupling the chamber and exterior of the chamber and atmosphere, and an upper one way diaphragm coupled to the receptacle member within the chamber whereby when the pressure generator button is pushed downwardly, pressurized air will flow from the chamber into the container and when the pressure generator button is moved upwardly, air will flow from atmosphere passed the upper diaphragm into the chamber; and means to resiliently urge the pressure generator button to the raised position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
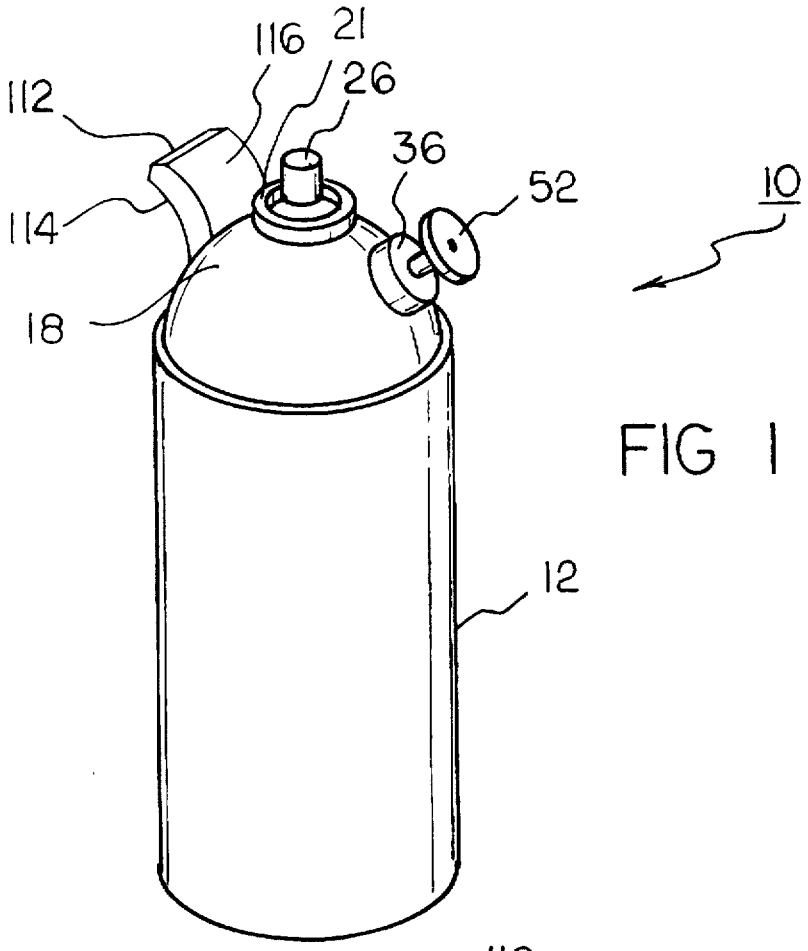
FIG. 1 is a perspective illustration of the preferred embodiment of advanced aerosol container constructed in accordance with the principles of the present invention.
Figure 2:
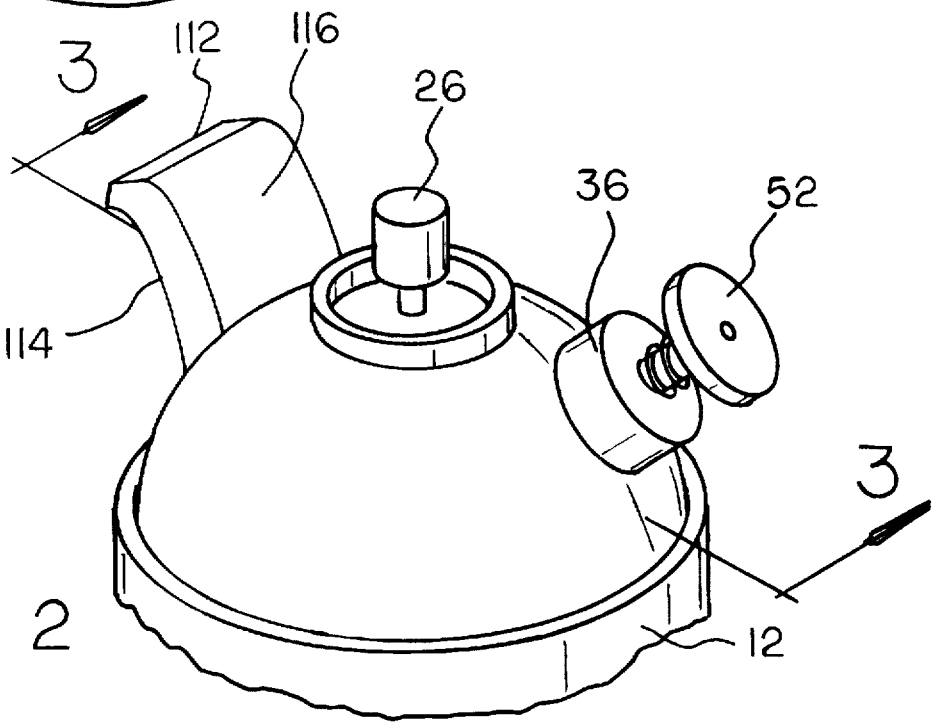
FIG. 2 is an enlarged perspective view of the upper portion of the device as shown in FIG. 1.
Figure 3:
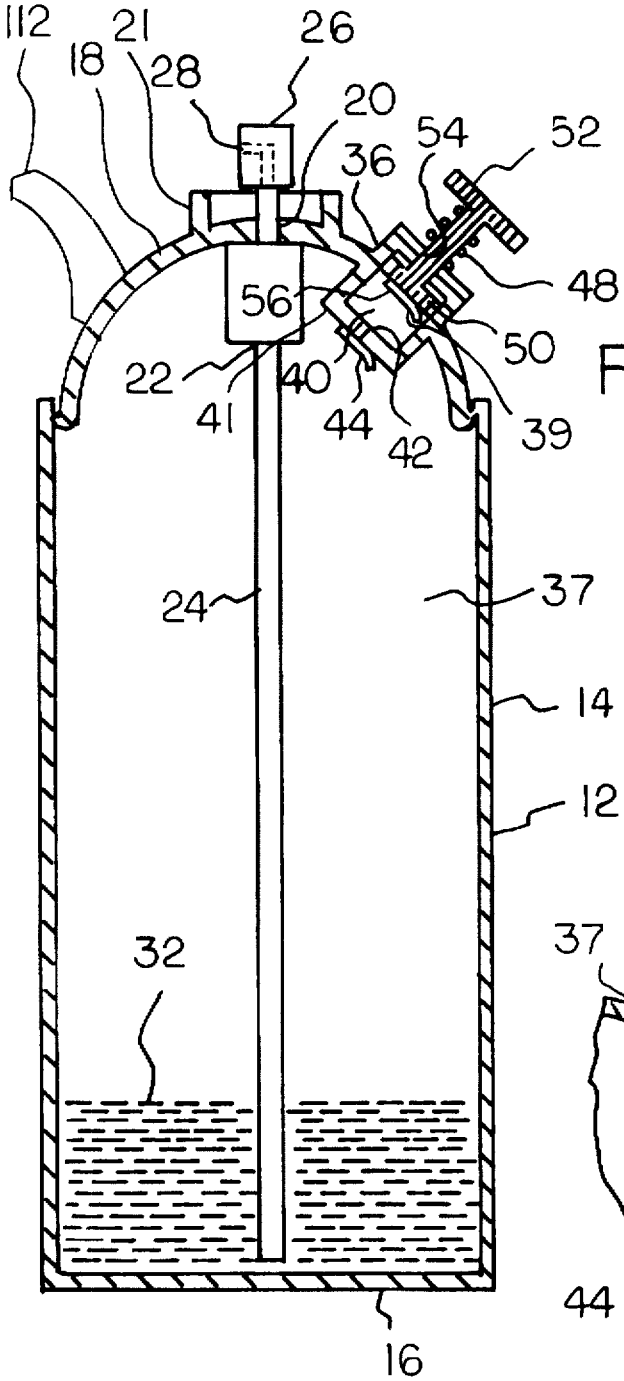
FIG. 3 is a sectional view taken along line 3—3 of FIG. 2.
Figure 4:
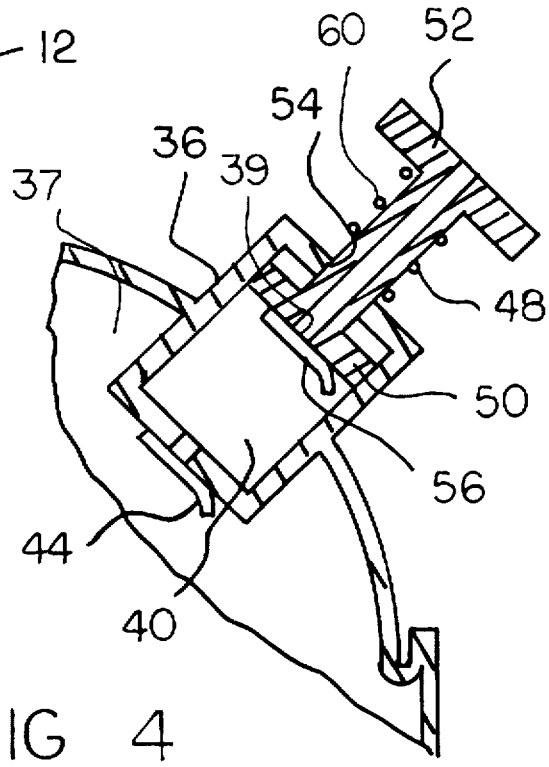
FIG. 4 is an enlarged sectional view of the valve shown in FIG. 3.

With reference now to the drawings, and in particular to FIG. 1 thereof, a new and improved advanced aerosol container embodying the principles and concepts of the present invention and generally designated by the reference numeral 10 will be described.

More specifically, it will note noted in FIGS. 1 through 4 there is disclosed a new and improved dispenser apparatus 10 for the storage of a liquid and for its dispensing therefrom in a mist form. Such an apparatus comprises a container 12 having cylindrical side walls 14, a bottom 16 and a dome shaped top 18 with a corresponding radius. The top 18 has a central vertical hole 20 aligned with a vertical axis extending therethrough. A flange 21 is formed about the central vertical hole 20 for releasably coupling with a conventional aerosol cap.

Located within the container is a dispenser 22 formed of a hollow tube 24. Such tube extends from adjacent to the bottom 16 or thereabove to above the hole 20 in the top of the containers. A button 26 is secured to the top of the tube 24. The button has a horizontal opening 28 in fluid communication with the tube 24. Such opening 26 is for the flow of liquid 32 from the bottom region of the container to exterior of the button and the container.

A pressure generator 36 is also provided for creating a high pressure atmosphere in the space 37 at the upper regions of the container 12. The pressure generator 36 includes a valve 39 formed at the top of the container 12 in a side of the spherical dome-shaped top. Such valve is offset from the hole 20. The valve 39 has a cylindrical chamber 40 extending into the container a distance less than the radius of the dome-shaped top. The cylindrical chamber 40 has first lower opening 42 with an associated first lower moveable one way diaphragm 44 which is coupled at an end thereof to an outer surface 41 of chamber 40 within container. A reciprocal member 48 has a central axis with an approximate 45 degree departure from the vertical axis. The reciprocal member comprises a cylindrical plunger 50 within the chamber 40. A button 52 is provided exterior of the chamber and container. A central aperture 54 extends therethrough coupling the chamber 40 with the exterior of the chamber and the atmosphere. A second upper moveable one way diaphragm 56 is coupled at an end thereof to the reciprocal member 48 within the chamber 40.

A handle 112 is attached to the dome-shaped top diametrically opposite the pressure generator. The handle has an arcuate lower portion 114 and a planar upper portion 116 for providing a user grip during use.

Due to this arrangement, when the pressure generator button 52 is pushed, pressurized air will flow from the chamber 40 into the container 12. When the pressure generator button 52 is moved upwardly, air will flow from atmosphere passed the upper diaphragm 56 into the chamber.

Lastly, a spring 60 is wrapped about the reciprocal member exterior the container and chamber to resiliently urge the pressure generator button 52 to the raised position.

Figure 5:
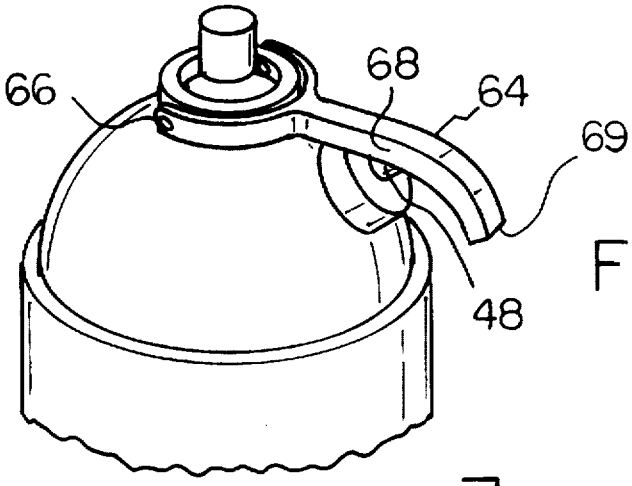
FIG. 5 is a perspective illustration of an alternate embodiment of the invention.

An alternate embodiment of the invention is shown in FIG. 5. According to such alternate embodiment, the apparatus further includes an operator controlled lever 64 with an inboard end comprising a pair of spaced members 66 pivotally coupled to the flange. Also included is an intermediate portion 68 coupled to an end most portion of the reciprocal member. Finally, an arcuate second end 69 extends outward to minimize the forces needed to pressurize the interior of the container 12.

Figure 6:
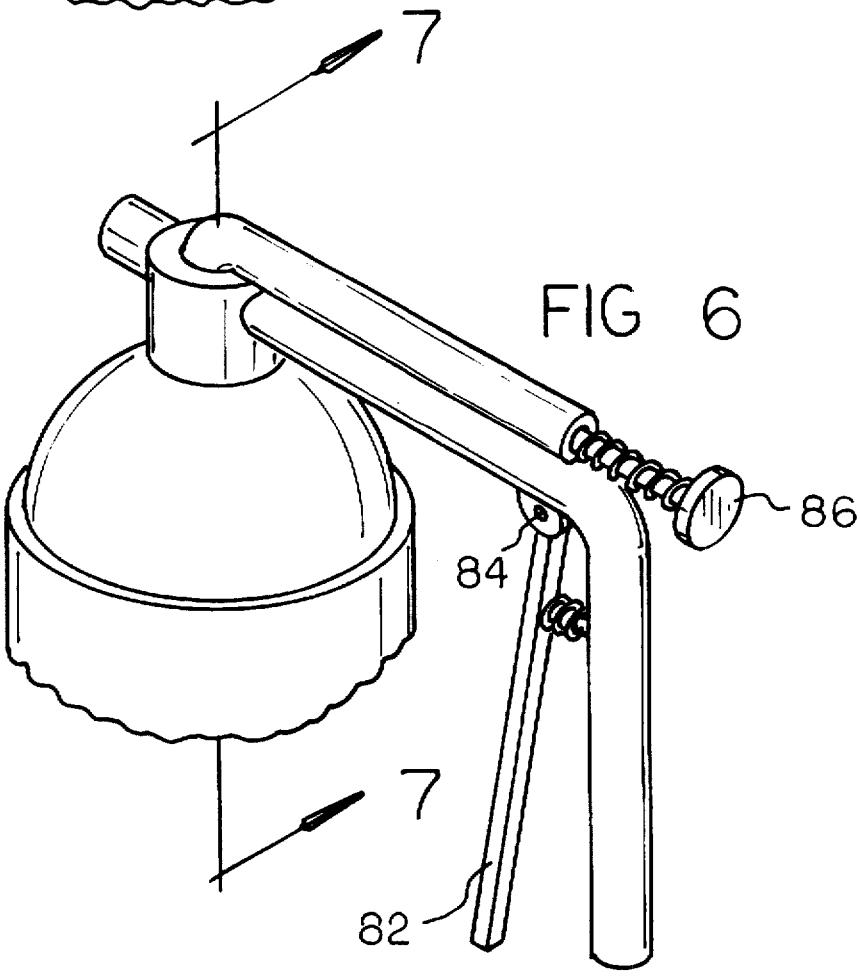
FIG. 6 is a perspective view of a further alternative embodiment of the invention.
Figure 7:
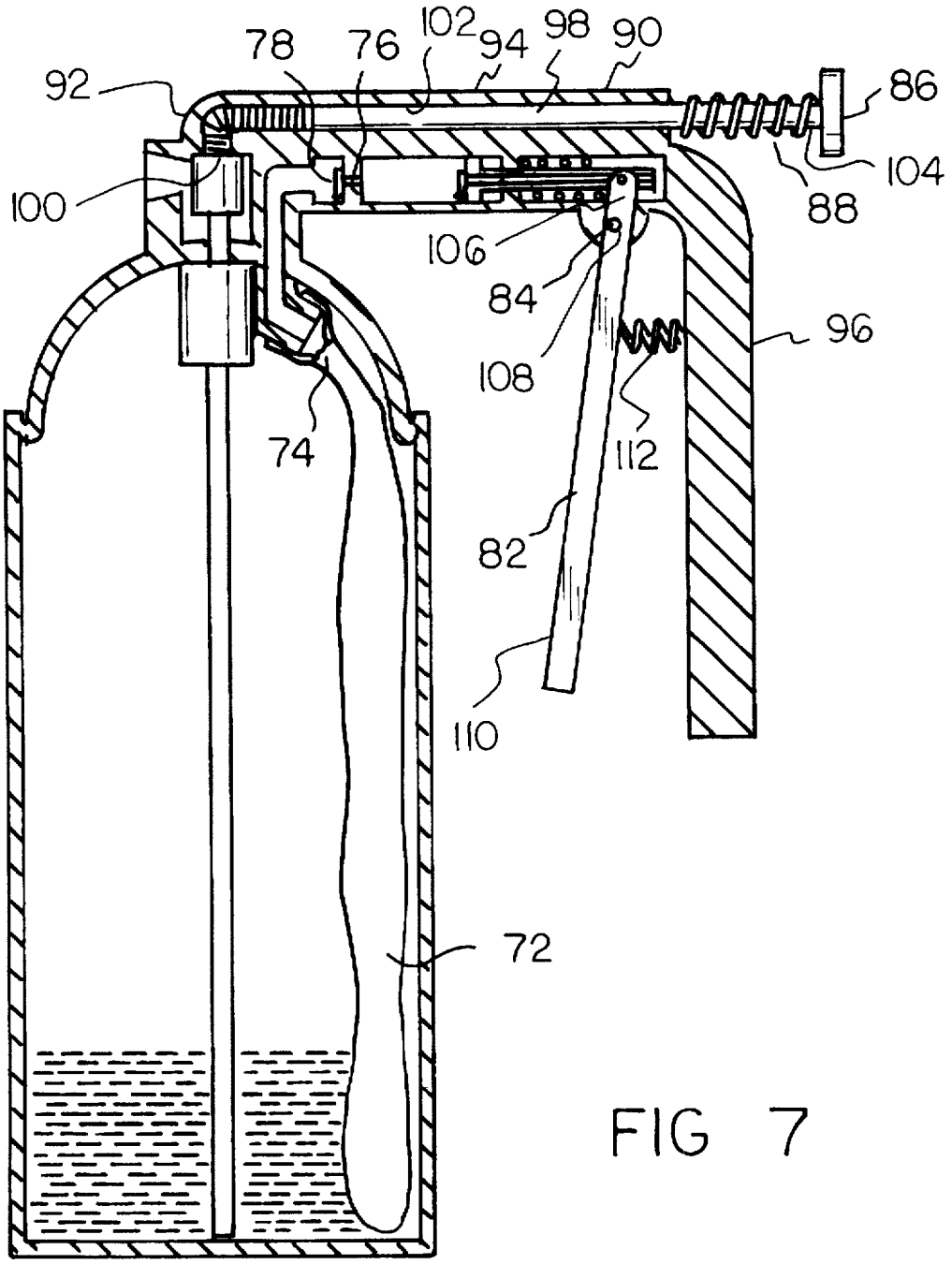
FIG. 7 is a sectional view taken along line 7—7 of FIG. 6.

Another alternate embodiment of the invention is shown in FIGS. 6 and 7. The apparatus of such alternate embodiment further includes an inflatable bladder 72. Such bladder 72 is located within the container 12, its open upper end 74 in fluid communication with the lower hole 76 and first diaphragm 78. An inflatable bladder 72 may be used in association with any of the embodiments of the invention.

In the embodiment of FIGS. 6 and 7, there is further included a handle 90 with an inboard end 92 attached to the dome-shaped top, an intermediate portion 94 extending horizontally therefrom and a downwardly extending outboard end 96 for grip by a user. An actuator rod 98 is slidably positioned within an aperture formed within the handle. The actuator rod has an inboard end 100 abutting the button of the container, an intermediate portion 102 in axial alignment with the intermediate portion of the handle and a outboard end 104 with an actuator button 86 coupled thereto. The actuator button 86 is adapted to be depressed by a thumb of a user gripping the handle. A spring 88 returns the actuator rod to its extended position as shown in FIG. 7. A pressure generator lever 82 is positioned in the same plane as the outboard end 96 of the handle having an inboard end 106 coupled to an end most portion of the reciprocal member, an intermediate portion 108 pivotally coupled to the handle and an outboard 110 end for gripping by a user. A spring 112 returns the lever to its extended position of FIG. 7. Such a construction allows the present invention to be more conveniently used in a hand-held, horizontal position.

Current aerosol containers are typically metal cans consisting of the container, the spray nozzle and hollow tube extending from the nozzle to the bottom of the container. The current process of manufacturing aerosol container requires pressurization with a gas prior to packaging for shipment. During use, the spray nozzle is depressed. This permits the container's internal pressure to force the contents through the hollow tube and out the spray nozzle as an aerosol. There are certain problems inherent to this process. These problems include:

a. Environmental Concerns—The contents of the pressurized gas is typically hazardous to the environment such as the chlorinated hydrocarbons that not only pollute the air but may be affecting the earth's ozone layer.

b. Shipment and Storage of Pressurized Containers—Shipment and storage of pressurized containers possess the potential problem of containers rupturing releasing its contents. Pressurized containers are especially sensitive to temperature restrictions. Since they usually contain hazardous material or hazardous substances, their movement is controlled by public law. Specifically, parts of the Code of Federal Regulation (CFR) 49 regulate movement of hazardous material. The use of pressurized containers may increase the hazard when transported.

c. Consumer Dissatisfaction—occasionally an aerosol container will fail to discharge its contents due to loss of internal pressure. They are especially subject to pressure loss during cold weather.

The subject invention, an advanced aerosol container, addresses these problems. The subject invention proposes installation of an air pump in aerosol containers to provide the internal air pressure required to produce an aerosol spray. This advanced container is superior to anything currently on the market.

The following are solutions to the problems previously discussed:

a. Environmental Concerns—The air pump is environmentally friendly. It eliminates the use of pollutants to provide internal pressure. Pressure inside the container will be the same gasses contained in the surrounding atmosphere. When released from the container, the container contents will settle out leaving the normal atmosphere.

b. Shipment and Storage of Pressurized Containers—Pressurization of containers would occur immediately prior to use. Problems inherent to shipment and storage of pressurized containers would be eliminated.

c. Consumer Dissatisfaction—The entire contents of a container could be utilized. When the container's internal pressure gets low, additional pressure could be applied via the air pump.

The air pump of the present invention is installed in the advanced aerosol containers during manufacture. The pump requires light pressure such as thumb/finger or hand grip to operate. After manufacture, the containers are shipped and stored unpressurized. The consumer applies the air pressure during actual use of the item.

The method and material used to produce the air pump are limitless with new ideas every day. A good example is the air pumps used for inflation of athletic shoes. For application with the advanced aerosol container, the pump must be small enough to fit the container. It must allow passage of air into the container and seal to prevent its escape through the air pump. Otherwise, specific design or material used to produce the pump is not important to the operational concept.

The air pump used to supply air pressure to the advanced aerosol container requires application of pressure to the pumping mechanism. This can be accomplished by:

a. Pressing a thumb or finger pressure detente fixed directly to the pump.

b. Additional air pressure may be achieved by constructing the pressure detente in the form of a lever. The pressure detente would be anchored to the container and the pump would form the fulcrum.

c. The air pump may also take the design of a pistol grip similar to the ones on squirt bottles. The difference is the pumping of air into the container instead of pumping the contents out. Since the pistol grip air pump would supply internal air pressure, the spray nozzle would not be operated by the pistol grip. The spray nozzle must cut off when released.

In cases where the direct application of atmosphere would adversely effect the container contents, an air bladder would be attached to the air pump, internal to the container. Pumping action would fill the air bladder which would in turn apply pressure to the container contents. When the spray nozzle is depressed, the contents will be forced through the hollow tube and out of the container in an aerosol spray.

The location of the air pump and spray nozzle in relation to each other is not important to operational concept. Location and appearance of the air pump and nozzle should be determined by customer desires.

Most aerosol containers are made of metal and are of fixed lid design. The aerosol container of the present invention could be made of any material compatible with the container contents. It must also be constructed to withstand the internal pressure required to produce the aerosol spray. The lid could be fixed or removable. Removable lids would require an adequate seal to prevent pressure leaks, but would give the benefit of refilling the container.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size materials, shape, form, function and manner of operation, assembly and use, are deemed readily apparent and obvious to one skilled in the art, and al equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. Apparatus for the storage of a liquid and for its dispensing therefrom in a mist form comprising, in combination:

a container having cylindrical side walls, a bottom and a spherical dome-shaped top with a corresponding radius, a central vertical hole aligned with a vertical axis extending therethrough, and a flange formed about the central vertical hole for releasably coupling with a conventional aerosol cap, the container including a space at the upper extent thereof;

a dispenser formed of a hollow tube extending from a lower extent of the container to above the hole in the top of the container with a button secured to the top of the tube, the button having a horizontal opening in fluid communication with the tube for the flow of liquid from the bottom of the container to the exterior of the button and the container;

a pressure generator for creating a high pressure atmosphere in the upper extent of the container; the pressure generator including a valve formed at the top of the container in a side of the spherical dome-shaped top offset from the hole; the pressure generator having a cylindrical chamber extending into the canister a distance less than the radius of the dome-shaped top, the cylindrical chamber having a first lower opening with an associated first lower movable one way diaphragm located within the container coupled at an end thereof to an outer surface of the chamber; a reciprocal member having a central axis with an approximate 45 degree departure from the vertical axis of the canister, the reciprocal member having a cylindrical plunger within the chamber and a button exterior of the chamber and container with a central aperture through the plunger and button coupling the chamber and exterior of the chamber and atmosphere; and a second upper movable one way diaphragm located within the chamber coupled at an end thereof to an outer surface of the reciprocal member within the chamber whereby when the pressure generator button is pushed, pressurized air will flow from the chamber into the container and when the pressure generator button is moved upwardly, air will flow from atmosphere passed the upper diaphragm into the chamber;

an arcuate handle attached to the dome-shaped top diametrically opposite the pressure generator; and a spring wrapped about the reciprocal member exterior the container and chamber to resiliently urge the pressure generator button to the raised position.

2. Apparatus for the storage of a liquid and for its dispensing therefrom in a mist form comprising:

a container having side walls, a bottom and a dome shaped top at its upper extent with a central vertical hole extending therethrough the container including a space at the upper extent thereof, the container further including an upwardly extending flange formed about the central vertical hole;

a dispenser formed of a hollow tube extending from a lower extent of the container to above the hole in the top of the container with a button secured to the top of the tube, the button having a horizontal opening in fluid communication with the tube for the flow of liquid from the bottom of the container to exterior of the button and the container;

a pressure generator for creating a high pressure in the container, the pressure generator including valve means formed in the container offset from the hole, a reciprocal member having a plunger, whereby when the pressure generator plunger is pushed, pressurized air will flow into the container; and means to resiliently urge the pressure generator button to the raising position including an operator controlled lever with an inboard end comprising a pair of spaced members pivotally coupled to the flange, an intermediate portion coupled to an end most portion of the reciprocal member and an arcuate second end extending outward to minimize the forces needed to pressurize the interior of the container.

3. Apparatus for the storage of a liquid and for its dispensing therefrom in a mist form comprising:

a container having side walls, a bottom and a dome shaped top at its upper extent with a central vertical hole extending therethrough the container including a space at the upper extent thereof, the container further including an upwardly extending flange formed about the central vertical hole;

a dispenser formed of a hollow tube extending from a lower extent of the container to above the hole in the top of the container with a button secured to the top of the tube, the button having a horizontal opening in fluid communication with the tube for the flow of liquid from the bottom of the container to exterior of the button and the container;

a pressure generator for creating a high pressure in the container, the pressure generator including valve means formed in the container offset from the hole, a reciprocal member having a plunger, whereby when the pressure generator plunger is pushed, pressurized air will flow into the container; and means to resiliently urge the pressure generator button to the raising position and further comprising:

a handle with an inboard end attached to the dome-shaped top, an intermediate portion extending horizontally therefrom and a downwardly extending outboard end for grip by a user;

an actuator rod slidably positioned within an aperture formed within the handle; the actuator rod having inboard end abutting the button of the container, an intermediate portion in axial alignment with the intermediate portion of the handle and a outboard end with an actuator button coupled thereto adapted to be depressed by a thumb of a user gripping the handle; and a pressure generator lever positioned in the same plane as the outboard end of the handle having an inboard end coupled to an end most portion of the reciprocal member, an intermediate portion pivotally coupled to the handle and an outboard end for gripping by a user.

* * * * *